US006321390B1

(12) United States Patent
Chiang

(10) Patent No.: US 6,321,390 B1
(45) Date of Patent: Nov. 27, 2001

(54) SWIMMING GOGGLES

(76) Inventor: Herman Chiang, 11F-2 No 634-9, Ching-Ping Rd., Chung-Ho City Taipei Hsien (TW)

( * ) Notice: Subject to any disclaimer, the term of this patent is extended or adjusted under 35 U.S.C. 154(b) by 0 days.

(21) Appl. No.: 09/644,524

(22) Filed: Aug. 21, 2000

(51) Int. Cl.[7] ..... A61F 9/02
(52) U.S. Cl. ..... 2/428
(58) Field of Search ..... 2/428, 430, 439, 2/440, 442; 351/43

(56) References Cited

U.S. PATENT DOCUMENTS 5,331,691 * 7/1994 Runckel ..... 2/428
6,029,284 * 2/2000 Kawashima et al. ..... 2/428

* cited by examiner

*Primary Examiner*—John J. Calvert
*Assistant Examiner*—Katherine Moran
(74) *Attorney, Agent, or Firm*—Pro-Techtor International Services

(57) ABSTRACT

A structural improvement of swimming goggles, comprising: lens frames to accommodate lenses, a nose bridge to connect the lens frames, and a protective pad that is glued to the lens frames, characterized in that: the thickness of the protective pad of the swimming goggles is inconsistent, and the side of the protective pad in contact with the user's face is designed to have different planes to fit the rims of the user's eye sockets, and specifically, the protective pad is formed in inconsistent thickness, based on the common properties at the rims of people's eye sockets, including the different depressions of upper and lower eye sockets and the depression near the nose bridge, the one side of protective pad in contact with the user's face is inclined along the upper and lower eye sockets, to make up for the difference of depressions to match the inclines, so the user can enjoy better and more comfortable contact, preventing water from seeping in even when the user is twitching his or her face.

15 Claims, 9 Drawing Sheets

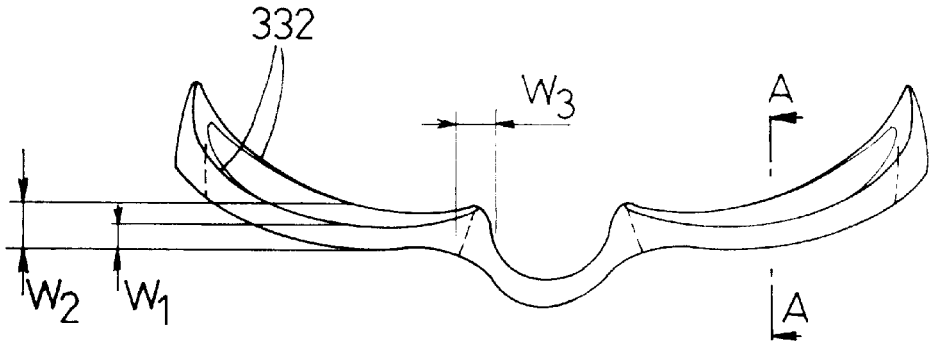
FIG.5
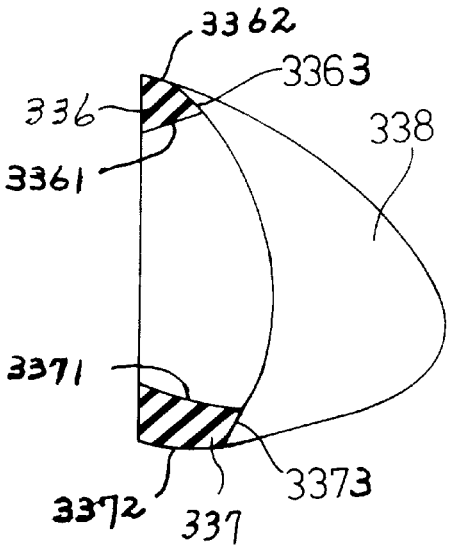
FIG.6 (A-A)

SWIMMING GOGGLES

BACKGROUND OF THE INVENTION

1. Field of the Invention

This invention relates to a type of swimming goggles enabling natural contact with the user's eye sockets for wearing comfort, without the risk of water seeping in.

2. Description of Related Art

Conventionally swimming goggles have included the function of a protective pad to enable wearing comfort and prevention from water seepage. The protective pads in conventional swimming goggles generally involve a sponge type or a sucking gasket type, in which, the side in contact with the user's face is designed to be flat and of consistent thickness. People's eye sockets, including upper and lower parts of eye socket and the area near the nose bridge, however, do have inconsistent depressions. So they have to be pressed and squeezed against the user's face in order to ensure tight contact with the eye sockets. As can be understood from FIGS. 1 and 2, when the swimming goggles 1 are not in use and are laid at an angle parallel to the human eyes, the distance t1 from the protective pad 10 of the swimming goggles 1 to the upper eye socket is smaller than the distance t2 from the protective pad 10 to the lower eye socket (please refer to FIG. 1), so they must be squeezed down on the face to prevent water seepage by pressing the protective pad 10 in closer contact with the lower eye socket. However, FIG. 2 shows the result after the pressing and squeezing process. Though the protective pad 10 and the upper and lower eye sockets are in closer contact, there is the existence of a clearance t3. In other words, the area of contact is large enough and sufficient. After being used for a while, the user will feel discomfort on the rims of eye sockets caused by the squeezing effect, especially on the lower parts of eye sockets. Discomfort will make the user twitch his face, which in turn results in a gap t3 and subsequent water seepage. In addition to that, the area of eye sockets near the nose bridge is particularly depressed. The conventional protective pad could not ensure contact in a larger area, so it will easily result in water seeping through. Furthermore, because the lower eye sockets are more depressed than the upper eye sockets, the squeezing process aimed at the lower eye sockets will result in an oblique angle between the lenses 10 of the swimming goggles 1 and the eyes 2, which means poor light reflection.

SUMMARY DESCRIPTION OF THE INVENTION

The main objective of this invention of swimming goggles is to provide a comfortable model of swimming goggles, which are shaped to fit the contours of the eye sockets. In other words, the protective pad is shaped to match the configuration of the upper and lower eye sockets and the depression of the nose bridge, to enable natural contact and wearing comfort, so that there will be no water seeping through even when the user is twitching his face muscles.

Another objective of this invention of swimming goggles is to provide a type of swimming goggles that enables parallel status of the lenses and the user's eyes, designed to have inconsistent thickness of the protective pad of the swimming goggles to match the outlines of eye sockets, so that a parallel angle can be maintained between the lenses and the user's eyes, and an excellent light reflection performance can be maintained when the goggles are in use. This invention of swimming goggles is characterized in that: the protective pad of the swimming goggles is designed to have inconsistent thickness, and specifically, the design of protective pad is aimed at the common properties around the rims of people's eye sockets: based on the different depressions of the upper and lower eye sockets and the depression of the nose bridge, the protective pad is shaped in inconsistent thickness to make up for the different depressions and fit the rims of eye sockets.

Another characteristic of this invention of swimming goggles is a non-flat surface on the side in contact with the user's face, that is, the side of the protective pad in contact with the face is inclined to suit the upper and lower eye sockets and the depression of the nose bridge, so that it will be in tight contact with the eye sockets.

BRIEF DESCRIPTION OF DRAWINGS

The invention can be fully understood by reading the following detailed description of the preferred embodiments, with reference made to the accompanying drawings, wherein:

FIG. 5 is a top view of the protective pad of this invention of swimming goggles.

FIG. 6 is a crosswise regional section view of the protective pad of this invention of swimming goggles.

BRIEF DESCRIPTION OF NUMERALS

| | | | |
|---|---|---|---|
| 3,3',3" | swimming goggles | 30,30',30" | right lens frame |
| 31,31'31" | left lens frame | 301,311 | front rim |
| 302,312 | rear rim | 303,313 | accommodating channel |
| 32 | nose bridge | | |
| 331 | fixing panel | 33,33',33" | protective pad |
| 333 | viewing window | 332,332',332" | contact panel |
| 335 | lower projection | 334 | upper projection |
| 338 | projected ear | 336,337 | incline |
| 341 | headband | 34 | headband unit |
| 36 | connector | 35 | lens |
| | | 361 | through hole |

DETAILED DESCRIPTION OF PREFERRED EMBODIMENTS

Figure 1:
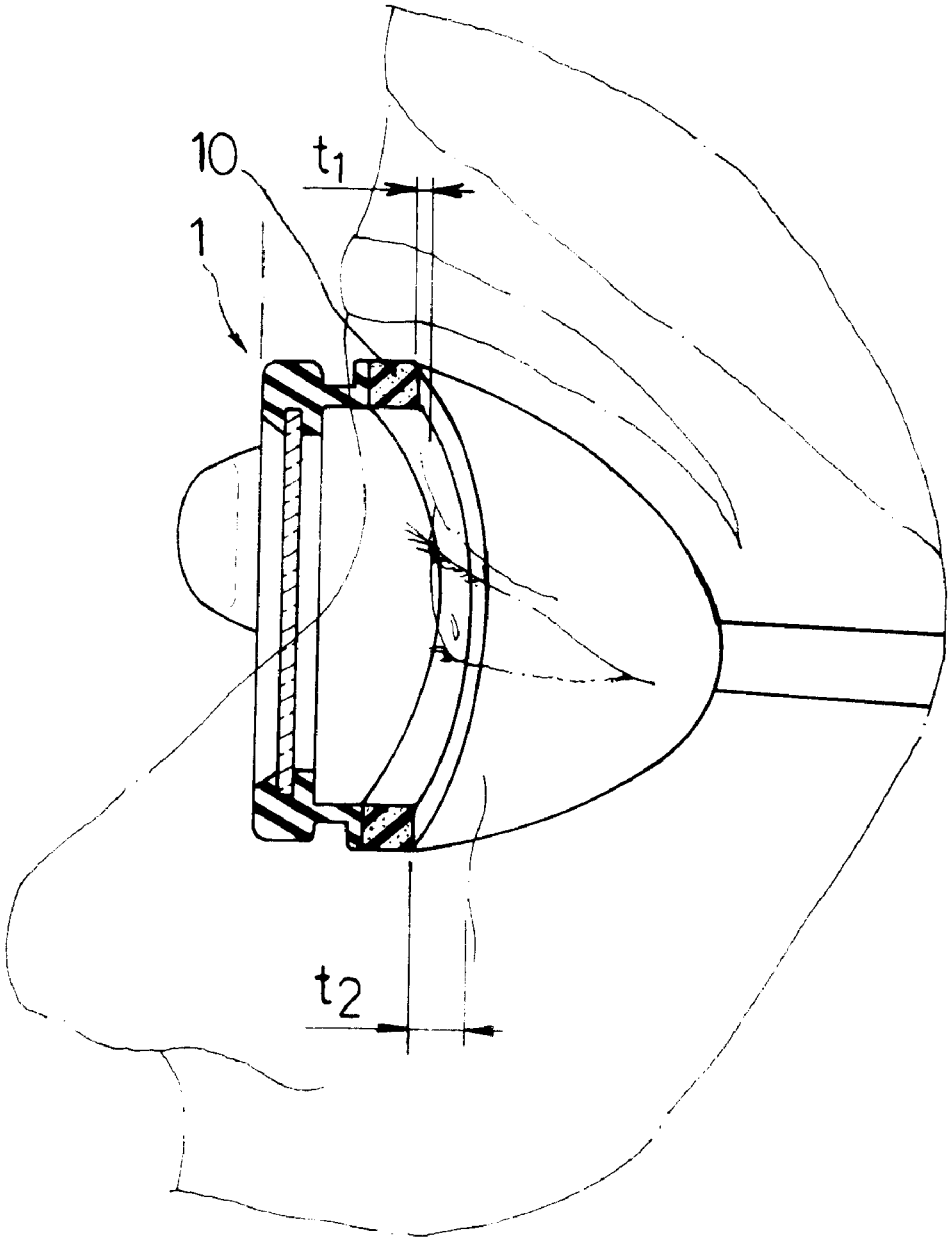
FIGS. 1 and 2 illustrate the prior art of swimming goggles before and after they are worn.
Figure 2:
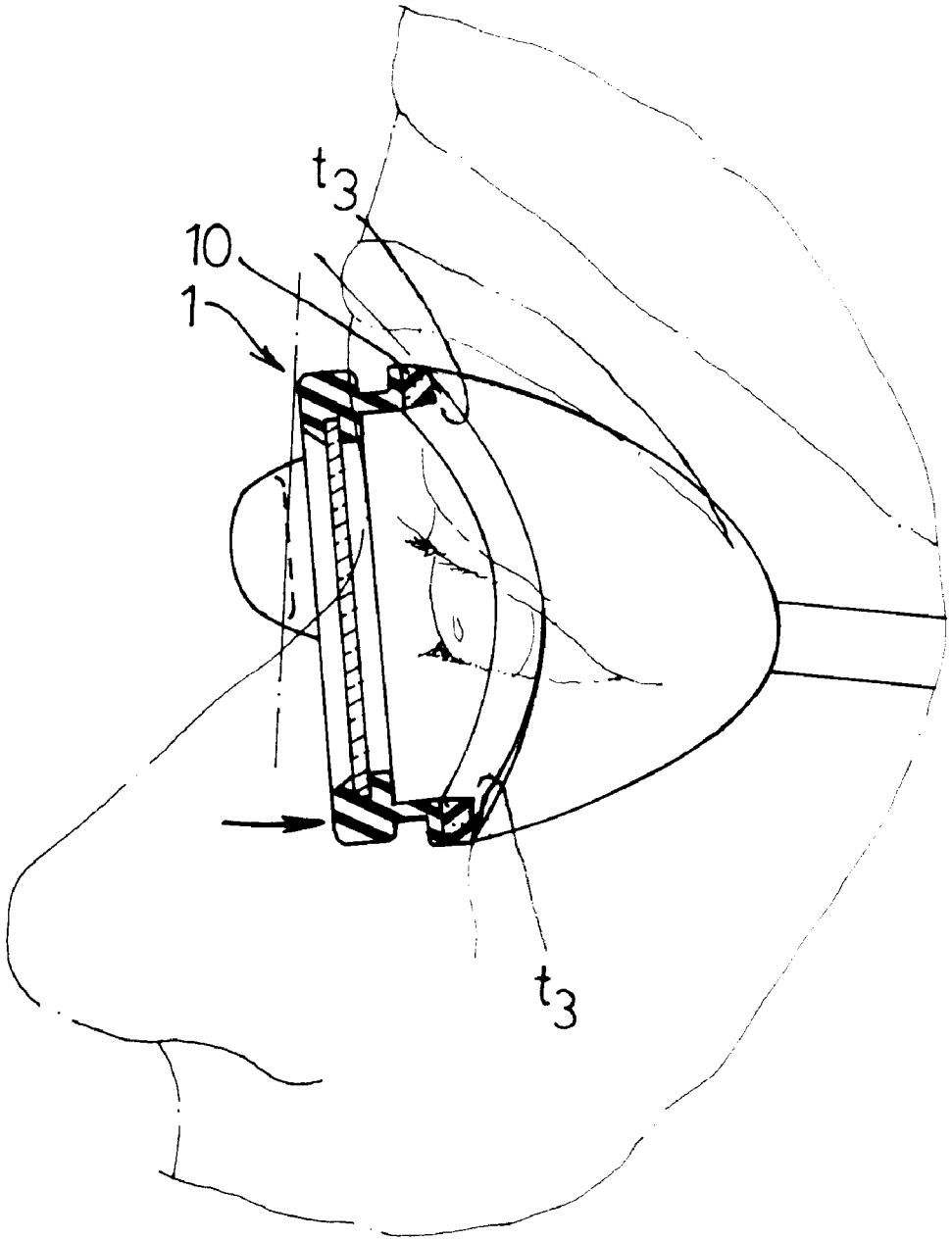
Figure 3:
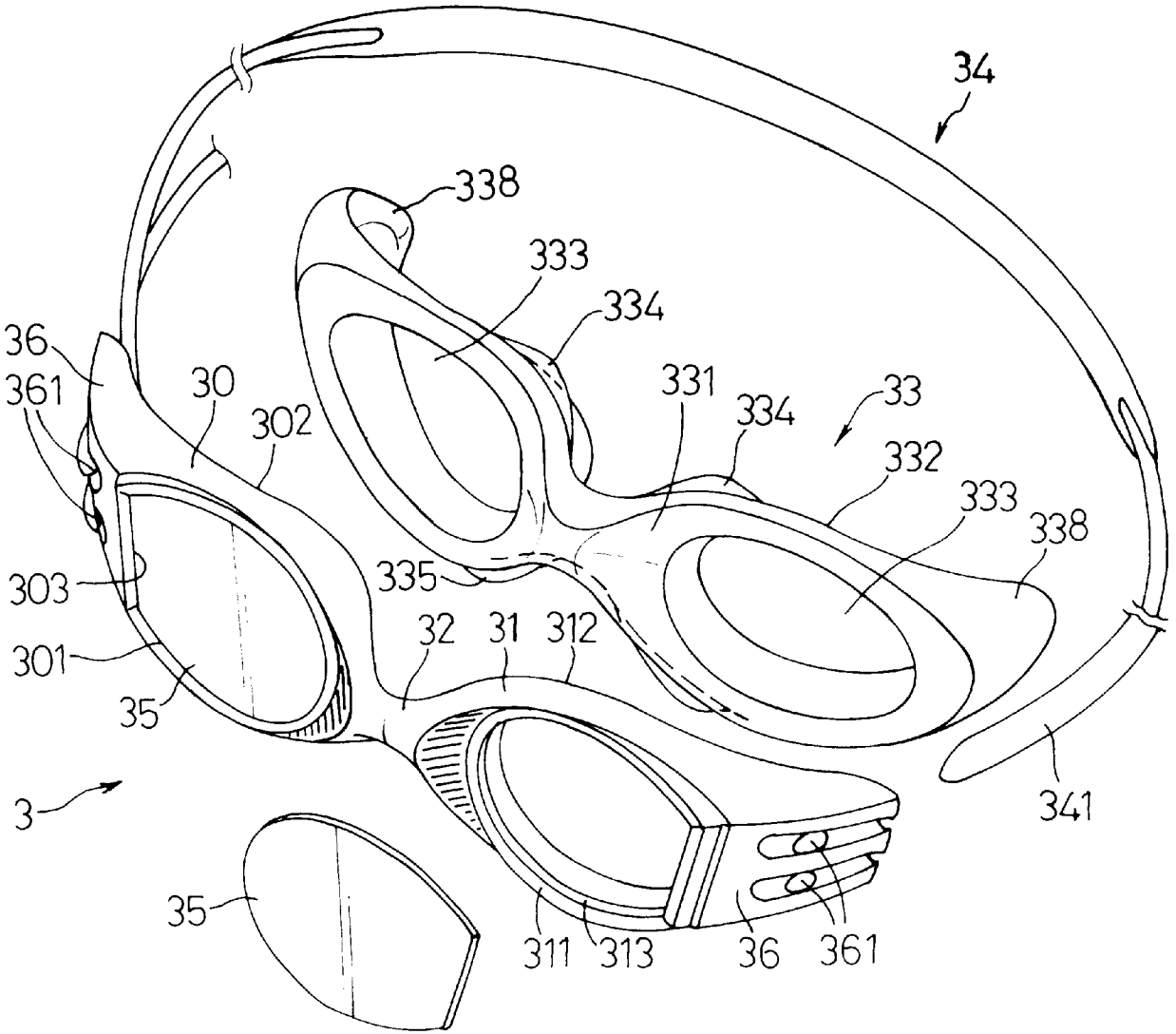
FIG. 3 is a perspective, disassembled view of this invention of swimming goggles.

As shown in FIG. 3, this invention of swimming goggles comprises: a right lens frame 30 and a left lens frame 31, a nose bridge 32, a protective pad and a headband unit 34. The right and left lens frames 30, 31 and the nose bridge 32 are integrally formed as one unit. The two lens frames respectively have front rims 301, 311 and rear rims 302, 312. Between the front and the rear rims are accommodating channels 303, 313 to accommodate the lens 35. On the sides of two lens frames are connectors 36. On the connectors 36 are two through holes 361 to be go across by a headband 341 of the headband unit 34.

Figure 7:
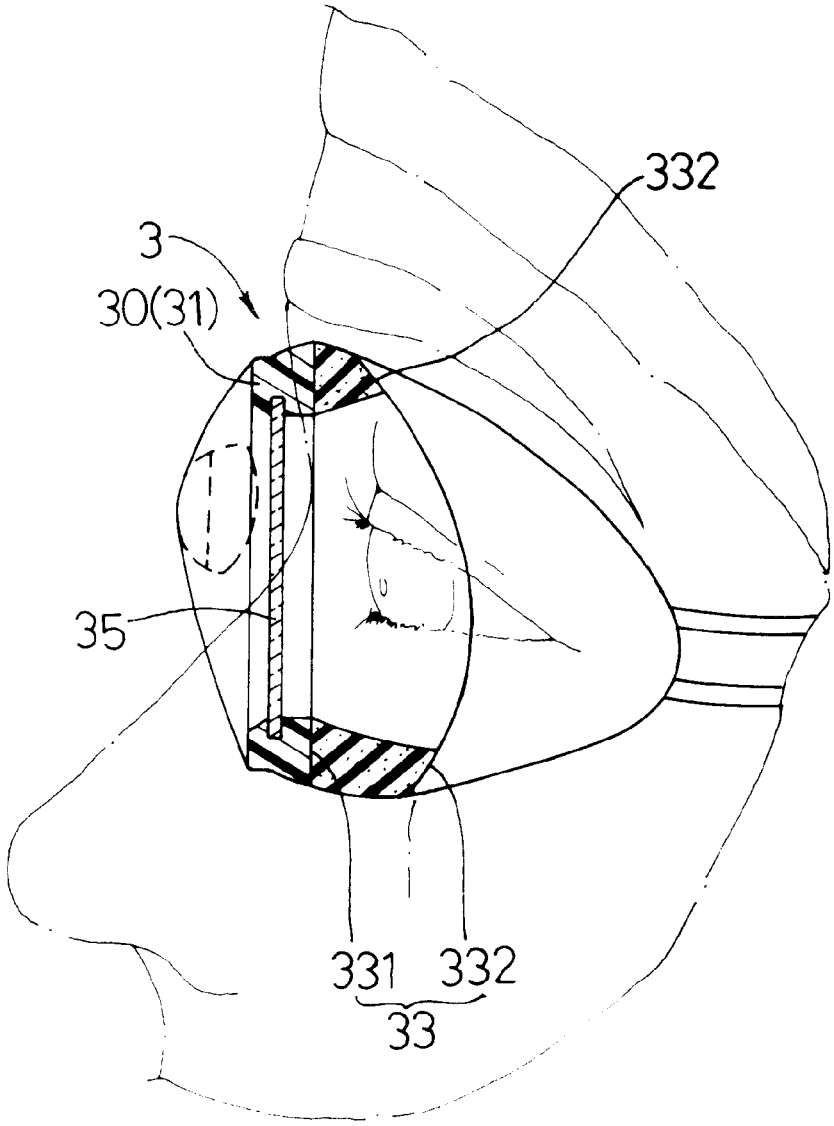
FIG. 7 is a section view of this invention of swimming goggles in application.

The protective pad 33 has the rear rims 302, 312 of the right and left lens frames 30, 31 and the fixing panel 331 of the nose bridge, and the contact panel 332 for contact with eye socket, in other words, the protective pad 33 is a prototype of one unit combining the left and right lens frames and the nose bridge, including two viewing windows 333 to correspond to the two lenses 35, through the viewing windows 333 the user can see beyond the lenses 35. The upper part of the contact panel 332 is to match the upper part of eye socket, and its lower part to match the lower part of eye socket. The thickness of the contact panel 332 is shown in FIG. 5, the thickness W1 of the upper contact panel is thinner than the thickness W2 of the lower contact panel, which is designed to tolerate the difference of depths of the upper and lower eye sockets, so that the user can enjoy a better contact with his upper and lower eye sockets. As shown in FIG. 7, because of the different thickness of the upper and lower parts of the contact panel 332 of the protective pad 32, the differences of depth between the upper and lower eye sockets can be made up to enable better and more comfortable contact, and the lenses 35 can be maintained at their parallel status to the advantage of the light reflected on the eyes. As shown in FIG. 6 which is a longitudinal section view of FIG. 5, the upper and lower parts of the contact panel 332 are not at a same level, in other words, the contact panel 332 has two inclines 336, 337 that are formed along the upper and lower parts of the eye sockets, of which the thickness of the incline 337 is thicker than the thickness of the incline 336 corresponding to the upper eye socket, since the incline 337 is located at the lower eye socket which is more depressed. And, since the upper and lower eye sockets are depressed toward the eyes, the upper and lower parts of the contact panel 332 are formed to have inclines, so that the upper and lower parts of the contact panel 332 have different from thickness. In other words, the sides 3361, 3371 closer to the eyeballs are thicker than their opposite sides 3362, 3372, while the sides 3363, 3373 in contact with the face have the formation of inclines in closer contact with the eye sockets, because of the difference of heights between the two sides of the upper and lower parts, 3361, 3371, and 3362, 3372.

As shown in FIG. 5, in addition to the different thickness of the contact panel for better contact with the upper and lower parts of the eye sockets, the side of the contact panel 332 corresponding to the nose bridge is also designed to have a different thickness. To match the depression of the nose bridge, the W3 is designed to have a projection, extending along the depression of the upper and lower parts of the contact panel 332, so it looks like a triangular arch when viewed from the top. Therefore, by way of filling up the depression at one side of the nose bridge and the design of different thickness at the upper and lower parts of the contact panel 332, the swimming goggles can be in better contact with the rims of eye sockets. The upper part of the contact panel 332 has an upper protrusion 334 to correspond to the upper edge of the nose bridge 32, so better contact can be attained between two eyebrows, providing resistance to leak and better wearing comfort. The lower part of the contact panel 332 has a lower protrusion 335 to correspond the lower edge of the nose bridge 32, so that better contact can be attained on two sides of the nose bridge, providing resistance to leak and better wearing comfort. Furthermore, the side of the protective pad 33 far away from the nose bridge 32 extends outwardly to have a protruded ear 338; the protruded ear 338 is stretchable to fit the different widths of face of different users.

Figure 4:
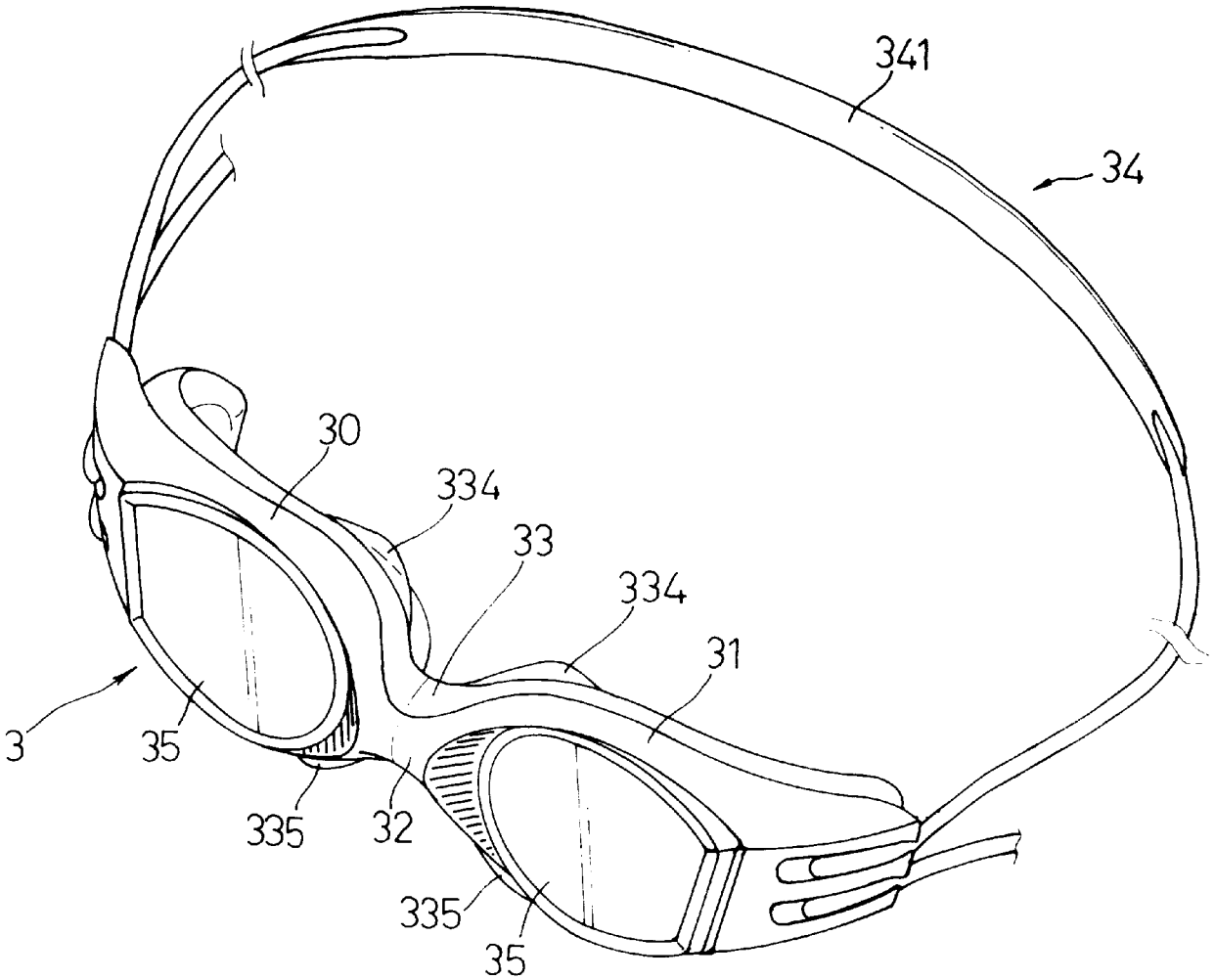
FIG. 4 is a perspective, assembled view of this invention of swimming goggles.

The headband unit 34 involves mainly a headband 341, its two ends respectively running from top to bottom through two through holes 361 on a connector 36. As clearly shown in FIG. 4, the main difference between the aforementioned assembly and the prior art of swimming goggles lies in that, the protective pad 33 is integrally designed to match the frame with lenses, thereby providing natural contact and better comfort, and ensuring no water seeping in even when the user is twitching his or her face. Meanwhile, parallel angles can be attained between the lenses and eyes, so there is excellent light reflection efficiency when the swimming goggles are worn by the user.

Figure 8:
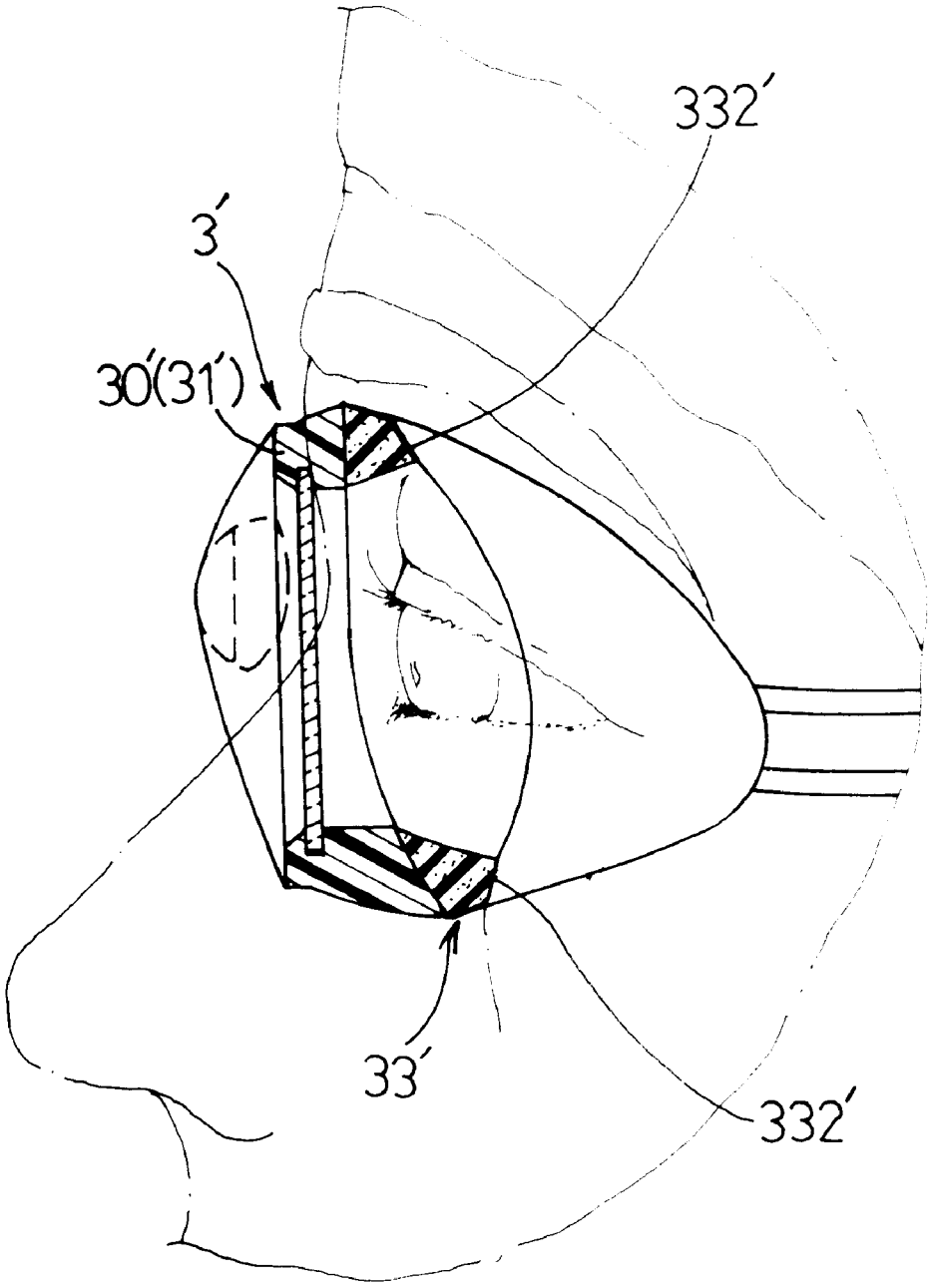
FIGS. 8 and 9 are a section view and a perspective view of a second embodiment of this invention of swimming goggles.
Figure 9:
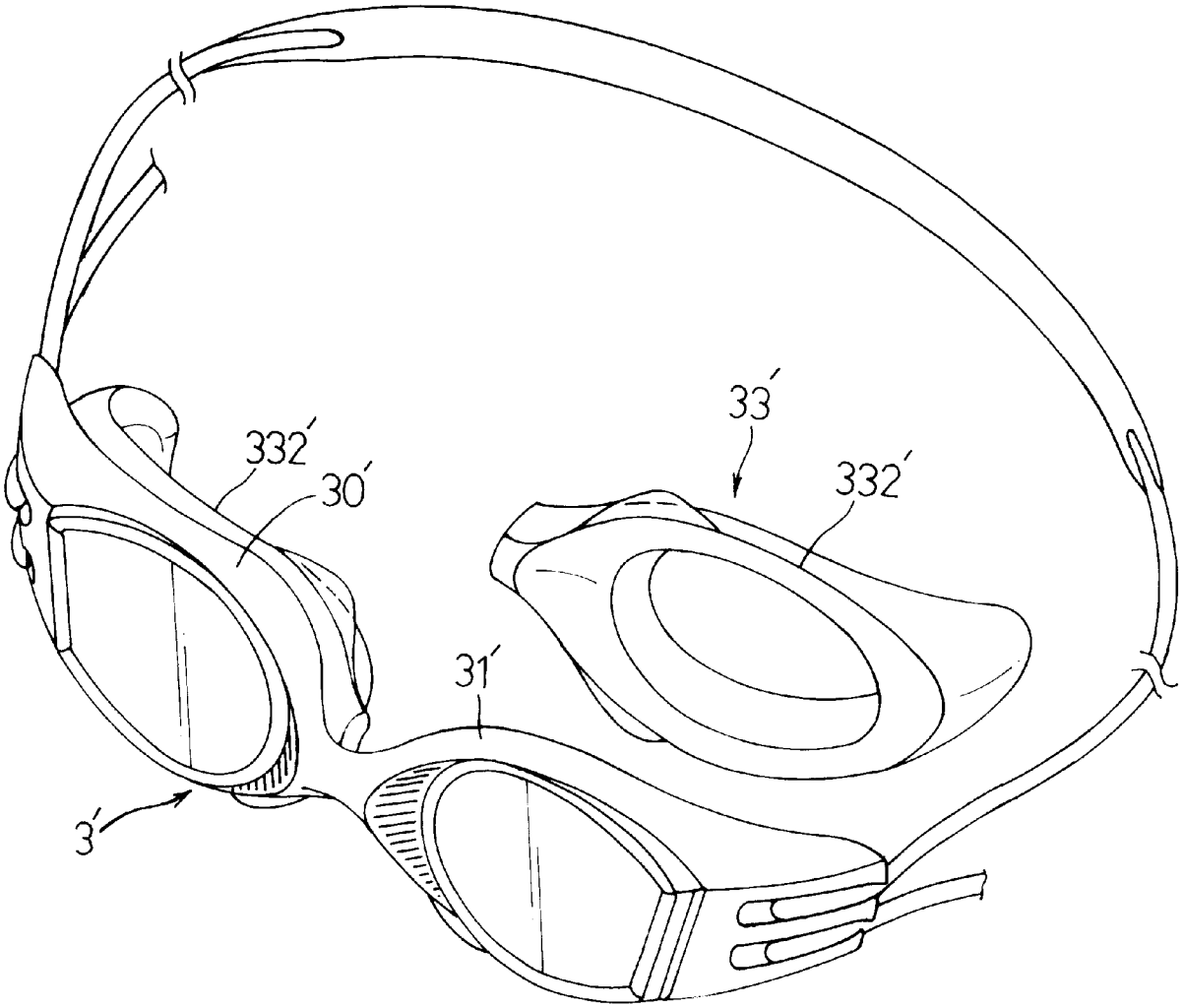
Figure 10:
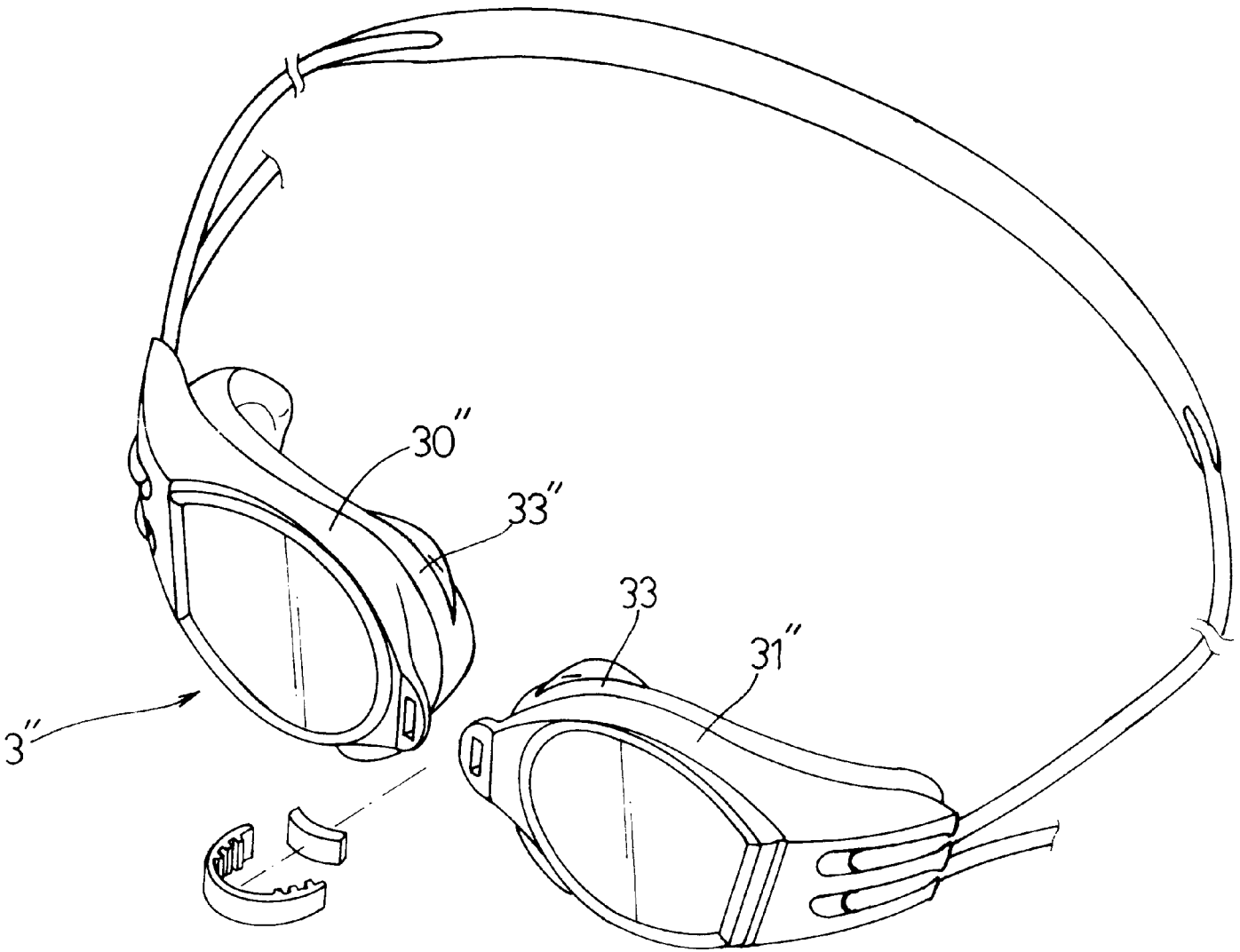
FIG. 10 is a perspective view of a third embodiment of this invention of swimming goggles.

FIGS. 8 and 9 illustrate a second embodiment of this invention. As shown in FIG. 8,the lens frames 30' (31') in this embodiment of swimming goggles 3" has different thickness on their upper and lower parts. Also, the contact panel 332' of the protective pad 33' is designed to have different thickness, but with less difference between the upper and lower parts. As shown in FIG. 9, the protective pad 33' of this invention is divided in a left and a right parts, which is different from the integrated one unit shown in the first embodiment above. FIG. 10 illustrates a third embodiment of the swimming goggles 3", in which the lens frames 30", 31 and the protective pad 33" are designed to have separate parts to achieve the same objective of this invention.

As described above, the objective of this invention can be achieved to qualify for a patent right, but the above description has covered only some preferred embodiments. Therefore, all modifications and variations made without changing the characteristics of this invention shall be included in the spirit and intent of this invention.

What is claimed is:

1. A structural improvement of swimming goggles that can be worn in close contact with the user's eye sockets, comprising:

a left lens frame and a right lens frame, having respectively front and rear rims, between the front and rear rims being accommodating channels to accommodate the lenses, and at the sides of the lenses being a connector;

a nose bridge, monobloc formed with said lens frames;

a protective pad, having a fixing panel located at the rear rims of the left and right lens frames and the nose bridge, and a contact panel in contact with eye sockets, wherein the thickness of said contact panel is inconsistent to match the upper and lower parts of eye sockets and the side near the nose bridge, to make up for the difference of depressions between the upper and lower eye sockets and the depression on one side near the nose bridge, to enable better contact with the eye sockets and maintain horizontal alignment of the lenses and the eyes; and a headband device that involves a connector between the lens frames.

2. The swimming goggles as claimed in claim 1, wherein the thickness of contact panel of said protective pad matching the upper parts of eye sockets is thinner than the part on the lower eye socket.

3. The swimming goggles as claimed in claim 2, wherein the side of said protective pad near the nose bridge is depressed along the parts of eye socket near the nose bridge upwardly and inclined gradually to the upper and lower eye sockets, forming a shape of triangular arch.

4. The swimming goggles as claimed in claim 3, wherein the one side of the contact panel of said protective pad in contact with the user's face corresponding to the upper and lower eye sockets is of inconsistent thickness, that is, the upper and lower parts of the contact panel are formed as inclines because the upper and lower eye sockets are depressed toward the eye balls, forming differences in their heights, in other words, the side near the eye balls is thicker than the opposite side, and because of the height difference of the upper and lower sides in contact with the user's face, inclines are formed near the eye sockets, for better contact with the upper and lower sockets.

5. The swimming goggles as claimed in claim 4, wherein the side of said protective pad far away from the nose bridge is extended outwardly to become projected ear, said projected ear can be stretched to fit the different widths of different users' faces.

6. The swimming goggles as claimed in claim 5, wherein the contact panel of said protective pad matching the upper edge of the nose bridge is extended to become an upper protrusion, to enable better contact between two eyebrows, providing resistance to water seepage and better wearing comfort.

7. The swimming goggles as claimed in claim 6, wherein the contact panel of said protective pad matching the lower edge of the nose bridge is extended to become a lower protrusion, to enable better contact on two sides of nose bridge, providing resistance to water seepage and better wearing comfort.

8. A structural improvement of swimming goggles that can be worn in close contact with the user's eye sockets, comprising:

a left lens frame and a right lens frame, having respectively front and rear rims, between the front and rear rims being accommodating channels to accommodate the lenses, and at the sides of the lenses being a connector;

a nose bridge, connecting the right and left lens frames;

a left and a right protective pad, each having a fixing panel located at the rear rims of the left and right lens frames, and a contact panel in contact with eye sockets, wherein at least one side of said contact panel matching the upper and lower eye sockets and near the nose bridge is designed to have inconsistent thickness, to make up for the difference of depressions of the upper and lower eye sockets and the depression on one side near the nose bridge, to enable better contact with the eye sockets and maintain horizontal alignment of the lens and the eyes; and a headband device that involves a connector between the lens frames.

9. The swimming goggles as claimed in claim 8, wherein the thickness of contact panel of said protective pad matching the upper parts of eye sockets is thinner than the part on the lower eye socket.

10. The swimming goggles as claimed in claim 9, wherein the side of said protective pad near the nose bridge is depressed along the parts of eye socket near the nose bridge upwardly and inclined gradually to the upper and lower eye sockets, forming a shape of triangular arch.

11. The swimming goggles as claimed in claim 10, wherein the one side of the contact panel of said protective pad in contact with the user's face corresponding to the upper and lower eye sockets is of inconsistent thickness, that is, the upper and lower parts of the contact panel are formed as inclines because the upper and lower eye sockets are depressed toward the eye balls, forming differences in their heights, in other words, the side near the eye balls is thicker than the opposite side, and because of the height difference of the upper and lower sides in contact with the user's face, inclines are formed near the eye sockets, for better contact with the upper and lower sockets.

12. A structural improvement of swimming goggles that can be worn in close contact with the user's eye sockets, comprising:

a left lens frame and a right lens frame, having respectively front and rear rims, between the front and rear rims being accommodating channels to accommodate the lenses, and at the sides of the lenses being a connector;

a nose bridge, monobloc formed with said lens frames;

a protective pad, having a fixing panel located at the rear rims of the left and right lens frames and the nose bridge, and a contact panel in contact with eye sockets, wherein the thickness of said contact panel is inconsistent to match the upper and lower parts of eye sockets and the side near the nose bridge, to make up for the difference of depressions between the upper and lower eye sockets and the depression on one side near the nose bridge, to enable better contact with the eye sockets and maintain horizontal alignment of the lenses and the eyes; and a headband device that involves a connector between the lens frames.

13. The swimming goggles as claimed in claim 12, wherein the thickness of contact panel of said protective pad matching the upper parts of eye sockets is thinner than the part on the lower eye socket.

14. The swimming goggles as claimed in claim 13, wherein the side of said protective pad near the nose bridge is depressed along the parts of eye socket near the nose bridge upwardly and inclined gradually to the upper and lower eye sockets, forming a shape of triangular arch.

15. The swimming goggles as claimed in claim 14, wherein the one side of the contact panel of said protective pad in contact with the user's face corresponding to the upper and lower eye sockets is of inconsistent thickness, that is, the upper and lower parts of the contact panel are formed as inclines because the upper and lower eye sockets are depressed toward the eye balls, forming differences in their heights, in other words, the side near the eye balls is thicker than the opposite side, and because of the height difference of the upper and lower sides in contact with the user's face, inclines are formed near the eye sockets, for better contact with the upper and lower sockets.

* * * * *